US010508543B2

(12) United States Patent
Shaffer

(10) Patent No.: US 10,508,543 B2
(45) Date of Patent: Dec. 17, 2019

(54) SCROLL DEVICE HAVING A PRESSURE PLATE

(71) Applicant: Air Squared, Inc., Broomfield, CO (US)

(72) Inventor: Bryce R Shaffer, Broomfield, CO (US)

(73) Assignee: Air Squared, Inc., Broomfield, CO (US)

( * ) Notice: Subject to any disclaimer, the term of this patent is extended or adjusted under 35 U.S.C. 154(b) by 187 days.

(21) Appl. No.: 15/731,324

(22) Filed: May 25, 2017

(65) Prior Publication Data

US 2017/0268514 A1 Sep. 21, 2017

Related U.S. Application Data

(63) Continuation-in-part of application No. 14/999,427, filed on May 4, 2016, now Pat. No. 10,221,852.
(Continued)

(51) Int. Cl.
*F01C 1/02* (2006.01)
*F04C 18/02* (2006.01)
(Continued)

(52) U.S. Cl.
CPC ..... *F01C 1/0215* (2013.01); *F04C 18/0215* (2013.01); *F04C 18/0223* (2013.01); *F04C 18/0284* (2013.01); *F04C 23/001* (2013.01); *F04C 23/02* (2013.01); *F04C 25/02* (2013.01); *F04C 29/0064* (2013.01); *F04C 29/0085* (2013.01); *F04C 29/005* (2013.01); *F04C 2240/20* (2013.01); *F04C 2240/30* (2013.01); *F04C 2240/603* (2013.01)

(58) Field of Classification Search
CPC .. F01C 1/0215; F01C 1/0246; F04C 18/0215; F04C 25/02; F04C 29/0064; F04C 29/0085; F04C 18/0223; F04C 18/0246
See application file for complete search history.

(56) References Cited

U.S. PATENT DOCUMENTS 801,182 A 10/1905 Creux
2,079,118 A 5/1937 Hingst
(Continued)

FOREIGN PATENT DOCUMENTS

CN 105402134 3/2016
DE 460936 6/1928
(Continued)

OTHER PUBLICATIONS

"Heat Pump and Refrigeration Cycle," Wikipedia, last updated May 10, 2013, 4 pages [retrieved online from: en.wikipedia.org/wiki/Heat_pump_and_refrigeration_cycle].
(Continued)

*Primary Examiner* — Deming Wan
(74) *Attorney, Agent, or Firm* — Sheridan Ross P.C.

(57) ABSTRACT

A scroll device has a housing having a fixed scroll plate and an orbiting scroll plate mounted therein on an idler shaft, the fixed scroll plate having a side having a fixed interleaved involute scroll and an outward facing side, the orbiting scroll plate having a side that has an orbiting interleaved involute scroll, an inlet port for the introduction of a working fluid into the device, and a pressure plate positioned adjacent to the outward facing side of the fixed scroll plate.

14 Claims, 2 Drawing Sheets

Related U.S. Application Data

(60) Provisional application No. 62/179,437, filed on May 7, 2015, provisional application No. 62/392,395, filed on May 31, 2016.

(51) Int. Cl.

| | |
|---|---|
| ***F04C 25/02*** | (2006.01) |
| ***F04C 29/00*** | (2006.01) |
| ***F04C 23/00*** | (2006.01) |
| ***F04C 23/02*** | (2006.01) |

(56) References Cited

U.S. PATENT DOCUMENTS 2,330,121 A 9/1943 Heintz
2,968,157 A 1/1961 Cronan
3,011,694 A 12/1961 Mulhouse et al.
3,470,704 A 10/1969 Kantor
3,613,368 A 10/1971 Doerner
3,802,809 A 4/1974 Vulliez
3,842,596 A 10/1974 Gray
3,986,799 A 10/1976 McCullough
3,986,852 A 10/1976 Doerner et al.
3,994,635 A * 11/1976 McCullough ..... F01C 1/0215 418/55.4
3,994,636 A 11/1976 McCullough et al.
3,999,400 A 12/1976 Gray
4,065,279 A 12/1977 McCullough
4,069,673 A 1/1978 Lapeyre
4,082,484 A 4/1978 McCullough
4,157,234 A 6/1979 Weaver et al.
4,192,152 A 3/1980 Armstrong et al.
4,300,875 A 11/1981 Fischer et al.
4,340,339 A 7/1982 Hiraga et al.
4,382,754 A 5/1983 Shaffer et al.
4,395,885 A 8/1983 Cozby
4,411,605 A 10/1983 Sauls
4,415,317 A 11/1983 Buttersworth
4,416,597 A 11/1983 Eber et al.
4,436,495 A 3/1984 McCullough
4,457,674 A 7/1984 Kawano et al.
4,462,771 A 7/1984 Teegarden
4,472,120 A 9/1984 McCullough
4,477,238 A 10/1984 Terauchi
4,511,091 A 4/1985 Vasco
4,673,339 A 6/1987 Hayano et al.
4,718,836 A 1/1988 Pottier et al.
4,722,676 A 2/1988 Sugimoto
4,726,100 A 2/1988 Etemad et al.
4,730,375 A 3/1988 Nakamura et al.
4,732,550 A 3/1988 Suzuki et al.
4,802,831 A 2/1989 Suefuji et al.
4,867,657 A 9/1989 Kotlarek et al.
4,875,839 A 10/1989 Sakata et al.
4,892,469 A 1/1990 McCullough et al.
5,013,226 A 5/1991 Nishida
5,037,280 A 8/1991 Nishida et al.
5,040,956 A 8/1991 Barito et al.
5,044,904 A 9/1991 Richardson, Jr.
5,051,079 A 9/1991 Richardson, Jr.
5,082,430 A 1/1992 Guttinger
5,108,274 A 4/1992 Kakuda et al.
5,127,809 A 7/1992 Amata et al.
5,142,885 A 9/1992 Utter et al.
5,160,253 A 11/1992 Okada et al.
5,214,932 A 6/1993 Abdelmalek
5,222,882 A 6/1993 McCullough
5,232,355 A 8/1993 Fujii et al.
5,242,284 A * 9/1993 Mitsunaga ..... F04C 27/005 418/55.3
5,258,046 A 11/1993 Haga et al.
5,338,159 A 8/1994 Riffe et al.
5,417,554 A 5/1995 Kietzman et al.
5,449,279 A * 9/1995 Hill ..... F04C 18/023 418/55.5
5,466,134 A 11/1995 Shaffer et al.
5,496,161 A 3/1996 Machida et al.
5,609,478 A * 3/1997 Utter ..... F04C 18/023 418/55.5
5,616,015 A 4/1997 Liepert
5,632,612 A 5/1997 Shaffer
5,632,613 A 5/1997 Shin et al.
5,752,816 A 5/1998 Shaffer
5,759,020 A 6/1998 Shaffer
5,803,723 A 9/1998 Suefuji et al.
5,836,752 A 11/1998 Calhoun et al.
5,842,843 A 12/1998 Haga
5,855,473 A 1/1999 Liepert
5,857,844 A 1/1999 Lifson et al.
5,873,711 A 2/1999 Lifson
5,938,419 A 8/1999 Honma et al.
5,951,268 A 9/1999 Pottier et al.
5,961,297 A 10/1999 Naga et al.
5,987,894 A 11/1999 Claudet
6,008,557 A 12/1999 Dornhoefer et al.
6,050,792 A 4/2000 Shaffer
6,068,459 A 5/2000 Clarke et al.
6,074,185 A 6/2000 Protos
6,129,530 A * 10/2000 Shaffer ..... F01C 17/06 29/888.022
6,179,590 B1 1/2001 Honma et al.
6,186,755 B1 2/2001 Haga
6,190,145 B1 2/2001 Fujioka et al.
6,193,487 B1 2/2001 Ni
6,283,737 B1 9/2001 Kazikis et al.
6,379,134 B2 4/2002 Iizuka
6,434,943 B1 8/2002 Garris
6,439,864 B1 8/2002 Shaffer
6,464,467 B2 10/2002 Sullivan et al.
6,511,308 B2 1/2003 Shaffer
6,712,589 B2 3/2004 Mori et al.
6,736,622 B1 5/2004 Bush et al.
6,905,320 B2 6/2005 Satoh et al.
6,922,999 B2 8/2005 Kimura et al.
7,124,585 B2 10/2006 Kim et al.
7,249,459 B2 7/2007 Hisanaga et al.
7,306,439 B2 * 12/2007 Unami ..... F01C 1/0223 418/55.3
7,314,358 B2 1/2008 Tsuchiya
7,458,152 B2 12/2008 Sato
7,458,414 B2 12/2008 Simon
7,836,696 B2 11/2010 Uno et al.
7,942,655 B2 5/2011 Shaffer
7,980,078 B2 7/2011 McCutchen et al.
8,007,260 B2 8/2011 Yanagisawa
8,087,260 B2 1/2012 Ogata et al.
8,186,980 B2 5/2012 Komai et al.
8,328,544 B2 12/2012 Iwano et al.
8,484,974 B1 7/2013 Monson et al.
8,668,479 B2 3/2014 Shaffer
8,674,525 B2 3/2014 Van Den Bossche et al.
9,022,758 B2 5/2015 Roof et al.
9,028,230 B2 5/2015 Shaffer
9,074,598 B2 7/2015 Shaffer et al.
9,784,139 B2 10/2017 Shaffer et al.
9,885,358 B2 2/2018 Shaffer
10,221,852 B2 3/2019 Shaffer et al.
2001/0043878 A1 11/2001 Sullivan et al.
2002/0011332 A1 1/2002 Oh et al.
2002/0071779 A1 6/2002 Moroi et al.
2003/0017070 A1 1/2003 Moroi et al.
2003/0138339 A1 7/2003 Scancarello
2003/0223898 A1 12/2003 Fujioka et al.
2004/0020206 A1 2/2004 Sullivan et al.
2004/0255591 A1 12/2004 Hisanga et al.
2005/0031469 A1 2/2005 Yanagisawa et al.
2006/0016184 A1 1/2006 Simon
2006/0045783 A1 3/2006 Yanagisawa et al.
2006/0130495 A1 6/2006 Dieckmann et al.
2007/0108934 A1 5/2007 Smith et al.
2007/0172373 A1 7/2007 Ni
2007/0231174 A1 10/2007 Ishizuki
2008/0159888 A1 7/2008 Nakayama et al.
2008/0193311 A1 8/2008 Helies

(56) References Cited

U.S. PATENT DOCUMENTS

| | | | | |
|---|---|---|---|---|
| 2009/0148327 | A1 | 6/2009 | Carter et al. | |
| 2009/0246055 | A1 | 10/2009 | Stehouwer et al. | |
| 2010/0111740 | A1 | 5/2010 | Ni | |
| 2010/0254835 | A1 | 10/2010 | Kane et al. | |
| 2010/0287954 | A1 | 11/2010 | Harman et al. | |
| 2011/0129362 | A1 | 6/2011 | Kameya et al. | |
| 2011/0256007 | A1* | 10/2011 | Shaffer | F04C 18/0223 418/5 |
| 2012/0134862 | A1 | 5/2012 | Hockliffe et al. | |
| 2013/0232975 | A1 | 9/2013 | Shaffer et al. | |
| 2014/0023540 | A1 | 1/2014 | Heidecker et al. | |
| 2017/0045046 | A1 | 2/2017 | Afshari | |
| 2017/0051741 | A1 | 2/2017 | Shaffer et al. | |
| 2017/0074265 | A1 | 3/2017 | Asami et al. | |
| 2017/0362962 | A1 | 12/2017 | Shaffer et al. | |
| 2018/0163725 | A1 | 6/2018 | Valdez et al. | |
| 2018/0163726 | A1 | 6/2018 | Shaffer et al. | |
| 2018/0216498 | A1 | 8/2018 | Shaffer et al. | |

FOREIGN PATENT DOCUMENTS

| | | |
|---|---|---|
| DE | 19957425 | 8/2000 |
| EP | 0513824 | 11/1992 |
| EP | 0780576 | 6/1997 |
| EP | 3 239 526 A1 | 1/2017 |
| GB | 0513827 | 10/1939 |
| GB | 2002455 | 2/1979 |
| GB | 1575684 | 9/1980 |
| JP | S56-019369 | 2/1981 |
| JP | S57-171002 | 10/1982 |
| JP | H05-157076 | 6/1993 |
| JP | H07-109981 | 4/1995 |
| JP | H07-324688 | 12/1995 |
| WO | WO 2004/008829 | 1/2004 |
| WO | WO 2009/050126 | 4/2009 |
| WO | WO 2015/164453 | 10/2015 |

OTHER PUBLICATIONS

"Involute," Wikipedia, last modified Jun. 2, 2012, 5 pages [retrieved online from: en.wikipedia.org/wiki/Involute].
"Oldham Coupler," Wikipedia, last modified, Feb. 9, 2010, 2 pages [retrieved online from: en.wikipedia.org/wiki/Oldham_coupler].
"Organic Rankine Cycle," Wikipedia, last modified May 19, 2013, 4 pages [retrieved online from: en.wikipedia.org/wiki/Organic_Rankine_Cycle].
"Rankine Cycle," Wikipedia, last modified Apr. 29, 2013, 4 pages [retrieved online from: en.wikipedia.org/wiki/Rankine_cycle].
"Scroll Compressor," Wikipedia, last modified Apr. 24, 2013, 3 pages [retrieved online from: en.wikipedia.org/wiki/Scroll_compressor].
"Thrust Bearing," Wikipedia, last modified Dec. 19, 2012, 2 pages [retrieved online from: en.wikipedia.org/wiki/Thrust_bearing].
International Search Report and Written Opinion for Interiantional (PCT) Patent Application No. PCT/US2018/064427, dated Feb. 5, 2019 14 pages.
International Search Report for International (PCT) Patent Application No. PCT/US01/43523, dated Jun. 5, 2002 1 page.
International Search Report for International (PCT) Patent Application No. PCT/US01/50377, dated May 13, 2002 1 page.
Partial Search Report for European Patent Application No. 13003663.5, dated May 28, 2014 5 pages.
Extended Search Report for European Patent Application No. 13003663.5, dated Sep. 3, 2014 11 pages.
International Search Report and Written Opinion for International (PCT) Patent Application No. PCT/US14/00076, dated Dec. 17, 2014 6 pages.
International Search Report and Written Opinion for International (PCT) Patent Application No. PCT/US18/00118, dated Sep. 24, 2018 19 pages.
Official Action for U.S. Appl. No. 11/703,585, dated Dec. 18, 2009 7 pages.
Official Action for U.S. Appl. No. 11/703,585, dated Jul. 20, 2010 7 pages.
Notice of Allowance for U.S. Appl. No. 11/703,585, dated Feb. 4, 2011 4 pages.
Official Action for U.S. Appl. No. 12/930,140, dated Jan. 14, 2013 22 pages.
Official Action for U.S. Appl. No. 12/930,140, dated Jun. 13, 2013 21 pages.
Notice of Allowance for U.S. Appl. No. 12/930,140, dated Oct. 24, 2013 12 pages.
Official Action for U.S. Appl. No. 13/066,261, dated Feb. 11, 2013 5 pages Restriction Requirement.
Notice of Allowance for U.S. Appl. No. 13/066,261, dated Apr. 4, 2013 13 pages.
Official Action for U.S. Appl. No. 13/987,486, dated Dec. 16, 2013 5 pages Restriction Requirement.
Official Action for U.S. Appl. No. 13/987,486, dated Apr. 23, 2014 13 pages.
Official Action for U.S. Appl. No. 13/987,486, dated Oct. 20, 2014 11 pages.
Notice of Allowance for U.S. Appl. No. 13/987,486, dated Jan. 5, 2015 5 pages.
Corrected Notice of Allowance for U.S. Appl. No. 13/987,486, dated Feb. 20, 2015 8 pages.
Official Action for U.S. Appl. No. 14/544,874, dated Dec. 23, 2016 5 pages Restriction Requirement.
Official Action for U.S. Appl. No. 14/544,874, dated Jan. 26, 2017 9 pages.
Official Action for U.S. Appl. No. 14/544,874, dated Jul. 21, 2017 6 pages
Notice of Allowance for U.S. Appl. No. 14/544,874, dated Sep. 28, 2017 5 pages.
Official Action for U.S. Appl. No. 15/330,223, dated Nov. 15, 2017 6 pages Restriction Requirement.
Official Action for U.S. Appl. No. 15/330,223, dated Feb. 7, 2018 10 pages.
Official Action for U.S. Appl. No. 15/330,223, dated Aug. 7, 2018 10 pages.
Official Action for U.S. Appl. No. 15/330,223, dated Jan. 11, 2019 14 pages.
Official Action for U.S. Appl. No. 14/507,779, dated Apr. 8, 2014 17 pages.
Official Action for U.S. Appl. No. 13/507,779, dated Dec. 1, 2014 17 pages.
Notice of Allowance for U.S. Appl. No. 14/507,779, dated Mar. 6, 2015 8 pages.
Official Action for U.S. Appl. No. 13/986,349, dated Jan. 21, 2015 25 pages.
Official Action for U.S. Appl. No. 13/986,349, dated Aug. 12, 2015 20 pages.
Official Action for U.S. Appl. No. 14/756,594, dated Mar. 29, 2017 13 pages.
Notice of Allowance for U.S. Appl. No. 14/756,594, dated Jun. 5, 2017 8 pages.
Official Action for U.S. Appl. No. 15/731,929, dated Jan. 31, 2019 11 pages.
Official Action for U.S. Appl. No. 14/999,427, dated Oct. 5, 2017 6 pages Restriction Requirement.
Official Action for U.S. Appl. No. 14/999,427, dated Feb. 9, 2018 9 pages.
Notice of Allowance for U.S. Appl. No. 14/999,427, dated Sep. 21, 2018 18 pages.
Official Action for U.S. Appl. No. 15/373,979, dated Jan. 29, 2019 12 pages.

* cited by examiner

SCROLL DEVICE HAVING A PRESSURE PLATE

CROSS REFERENCE TO RELATED APPLICATION

This patent application is a non-provisional of the provisional application having Ser. No. 62/392,395, filed on May 31, 2016; and this application also claims priority as a continuation-in-part to the non-provisional patent application having Ser. No. 14/999,427, filed on May 4, 2016, as a continuation-in-part, and which latter application is a non-provisional of the provisional application having Ser. No. 62/179,437, filed on May 7, 2015.

BACKGROUND OF THE DISCLOSURE

This disclosure relates to scroll devices and more particularly to a scroll device having a pressure plate for preventing damage to the scroll device.

Scroll type devices, such as compressors, typically employ two interleaving scrolls that often, but not exclusively, employ involute vane geometries to pump, compress, expand, or pressurize fluids, such as liquids or gases, with such liquids or gases typically being introduced into the scroll type device through an inlet or input port and discharged through a discharge port. One of the interleaving scrolls is held fixed while the other scroll orbits eccentrically, without rotating, to trap and pump or compress pockets of fluid between the scrolls. Although other techniques are used for effecting suitable relative motion between the scrolls such as co-rotating the scrolls. The scroll type devices having two interleaving scrolls generally tend to be compact and operate more smoothly, quietly, and reliably than previous types of compressors.

Scroll devices have been used as compressors and expanders, and vacuum pumps for many years. In general, these devices may have a single stage of compression having a spiral involute or scroll upon a rotating plate orbits within a fixed spiral or scroll upon a stationery plate. A motor shaft turns a shaft that orbits a scroll eccentrically within a fixed scroll. The eccentric orbit forces a gas through and out of the fixed scroll thus creating a pressure in a container in communication with the fixed scroll. An expander operates with the same principle only turning the scrolls in reverse. When referring to compressors, it is understood that a vacuum pump can be substituted for compressor and that an expander can be an alternate usage when the scrolls operate in reverse from an expanding gas.

Currently, scroll devices may be semi-hermetic or hermetic scroll devices which have a fixed scroll positioned on an end of a compressor for sealing between ambient pressure and operating pressure. The scroll is machined on the inside of the scroll. The fixed scroll takes an axial pressure load from the difference between ambient pressure and internal operation pressure. This results in deflections on the spiral involute. These deflections on the fixed scroll can result in deformation of the scroll geometry machined on the inside of the scroll. The deformation of the scroll geometry can result in the involute contacting the orbiting scroll component. This can lead to failure of the scroll and should be avoided.

The present disclosure overcomes the limitations of the prior art where a need exists for preventing a deformation of the scroll geometry. It would also be advantageous to have a scroll device having a pressure plate that is capable of preventing damage to the scroll regardless of whether an interface pressure is at low operating pressure or at high operating pressure.

SUMMARY OF THE DISCLOSURE

Accordingly, the present disclosure is a scroll device that comprises a housing having a fixed scroll plate and an orbiting scroll plate mounted therein on an idler shaft, the fixed scroll plate having a side having a fixed interleaved involute scroll and an outward facing side, the orbiting scroll plate having a side that has an orbiting interleaved involute scroll, an inlet port for the introduction of a working fluid into the device, and a pressure plate positioned adjacent to the outward facing side of the fixed scroll plate.

In another form of the present disclosure, a scroll device is disclosed which comprises a housing having a fixed scroll plate and an orbiting scroll plate mounted therein on an idler shaft, the fixed scroll plate having a side having a fixed interleaved involute scroll and an outward facing side, the orbiting scroll plate having a side that has an orbiting interleaved involute scroll, an inlet port for the introduction of a working fluid into the device, an O-ring located around the idler shaft, and a pressure plate positioned adjacent to the outward facing side of the fixed scroll plate.

In still another form of the present disclosure, a scroll device is disclosed which comprises a housing having a fixed scroll plate and an orbiting scroll plate mounted therein on an idler shaft, the fixed scroll plate having a side having a fixed interleaved involute scroll and an outward facing side, the orbiting scroll plate having a side that has an orbiting interleaved involute scroll, an inlet port for the introduction of a working fluid into the device, an O-ring located around the inlet port, and a pressure plate positioned adjacent to the outward facing side of the fixed scroll plate.

Therefore, the present disclosure provides a new and improved scroll device having a pressure plate with the scroll device being from the machine class of compressors, vacuum pumps, liquid pumps, and expanders for gases.

The present disclosure provides a scroll device having a pressure plate for protecting a fixed scroll within the scroll device from high differential pressure between atmospheric pressure and operating pressures within the scroll device.

The present disclosure also provides a scroll device having a pressure plate that may be used with a scroll device having an interface pressure being at a low operating pressure.

The present disclosure is directed to a scroll device having a pressure plate that may be used with a scroll device having an interface pressure being at a high operating pressure.

The present disclosure also provides a scroll device having a pressure plate with the pressure plate preventing damage to the scroll device.

These and other advantages may become more apparent to those skilled in the art upon review of the disclosure as described herein, and upon undertaking a study of the description of its preferred embodiments, when viewed in conjunction with the drawings.

DESCRIPTION OF PREFERRED EMBODIMENTS

Figure 1:
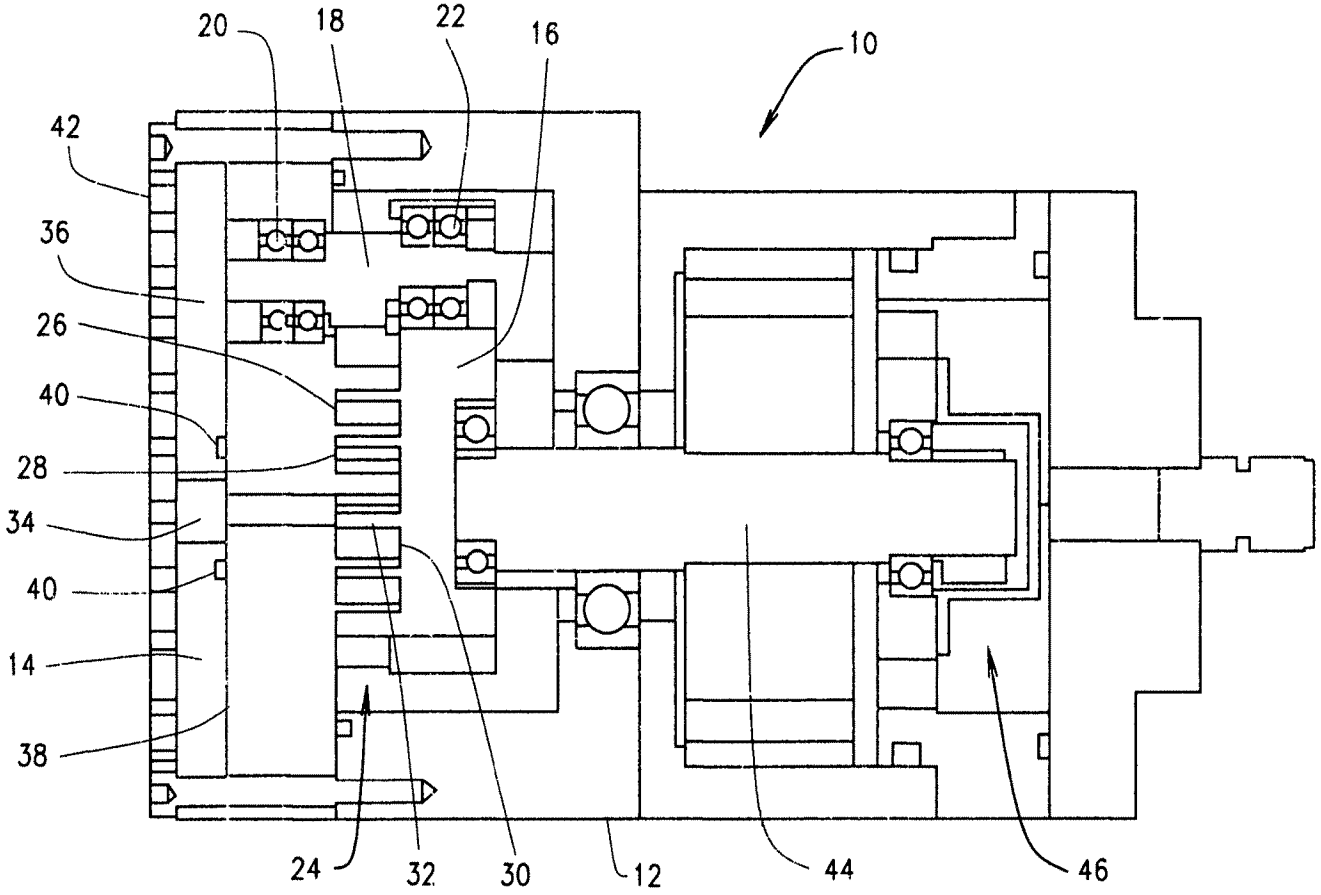
FIG. 1 shows a sectional view of a scroll device having a pressure plate constructed according to the present disclosure.

Referring now to the drawings, wherein like numbers refer to like items, number 10 identifies a preferred embodiment of a scroll device having a pressure plate constructed according to the present disclosure. With reference now to FIG. 1, the scroll device 10 is illustrated comprising a housing 12 which seals the device 10 from the atmosphere, a fixed scroll plate 14 and an orbiting scroll plate 16 mounted therein on an idler shaft 18 rotatable within associated bearings 20 and 22. The idler shaft 18 and two additional idler shafts (not shown) roughly spaced 120° apart are designed to take the axial loads and to control the motion of and clearance between the scroll plates 14 and 16 as the plates 14 and 16 move relative to one another. The scroll plates 14 and 16 together form a scroll set or scroll plate pair 24. The fixed scroll plate 14 has a side 26 having a fixed interleaved involute scroll 28. The orbiting scroll plate 16 has a side 30 that has an orbiting interleaved involute scroll 32. The scroll plates 14 and 16 move relative to one another, such as in an eccentric orbit relative to one another. The involute scrolls 28 and 32 are interleaved spiral projections that mesh together to expand or contract a working fluid (not shown) that is provided to the scroll set 24. The device 10 has an inlet port 34 in the case of an expander, for the introduction of a working fluid (not shown) into the device 10 and the scroll set 24. A pressure plate 36 is positioned adjacent to an outward facing side 38 of the fixed scroll plate 14. The pressure plate 36 takes the bulk of the differential pressure between atmospheric pressure and operating pressures within the device 10. By providing the pressure plate 36, the pressure plate 36 is able to deflect and deflection of the fixed scroll plate 14 can be minimized. In this manner, the pressure plate 36 prevents any damage to the scroll set 24. The pressure plate 36 can be larger than the fixed scroll plate 14. The pressure plate 36 is designed to use the low operating pressure as the interface pressure between the pressure plate 36 and fixed scroll 14, in the device 10. The low operating pressure of the device 10 refers to the pressure at the inlet port (not shown). If the scroll device 10 is a compressor then the low operating pressure will be at the inlet port 34. A high operating pressure will be at the outlet port 34 of the device 10. Also, the device 10 has an O-ring 40 provided or located around the inlet port 34. The housing 12 may also have fins 42 provided thereon for transferring heat primarily from the fixed scroll 14 and the orbiting scroll 16 to the housing 12 for evacuation by conduction or a fan (not shown) integrated into the housing 12. A shaft 44 may be connected to the orbiting scroll plate 16. A motor 47 may be connected to the shaft 44 to rotate the shaft 44 and in turn rotate the orbiting scroll plate 16. The motor may be magnetically connected to the shaft 44 by a magnetic coupling (not shown). The magnetic coupling is used for transmitting the torque from the motor to the orbiting scroll plate 16 for appropriate rotation without leakage of the working fluid to the atmosphere. Generally, the motor supplies rotation to the magnetic coupling which then imparts rotation and torque to the shaft 44 and the orbiting scroll plate 16 for usage as a compressor or vacuum pump while a generator (not shown) supplies rotation to the orbiting scroll plate 16 when the device 10 is used as an expander.

Although one idler shaft 18 is shown, typically there are three idler shafts that are preferably spaced approximately 120° from each other around the outside of the scroll plates 14 and 16. Although the idler shafts 18 is shown positioned between the fixed scroll plate 14 and the orbiting scroll plate 16, the idler shaft 18 could just as easily be located between the orbiting scroll plate 16 and the housing 12.

Figure 2:
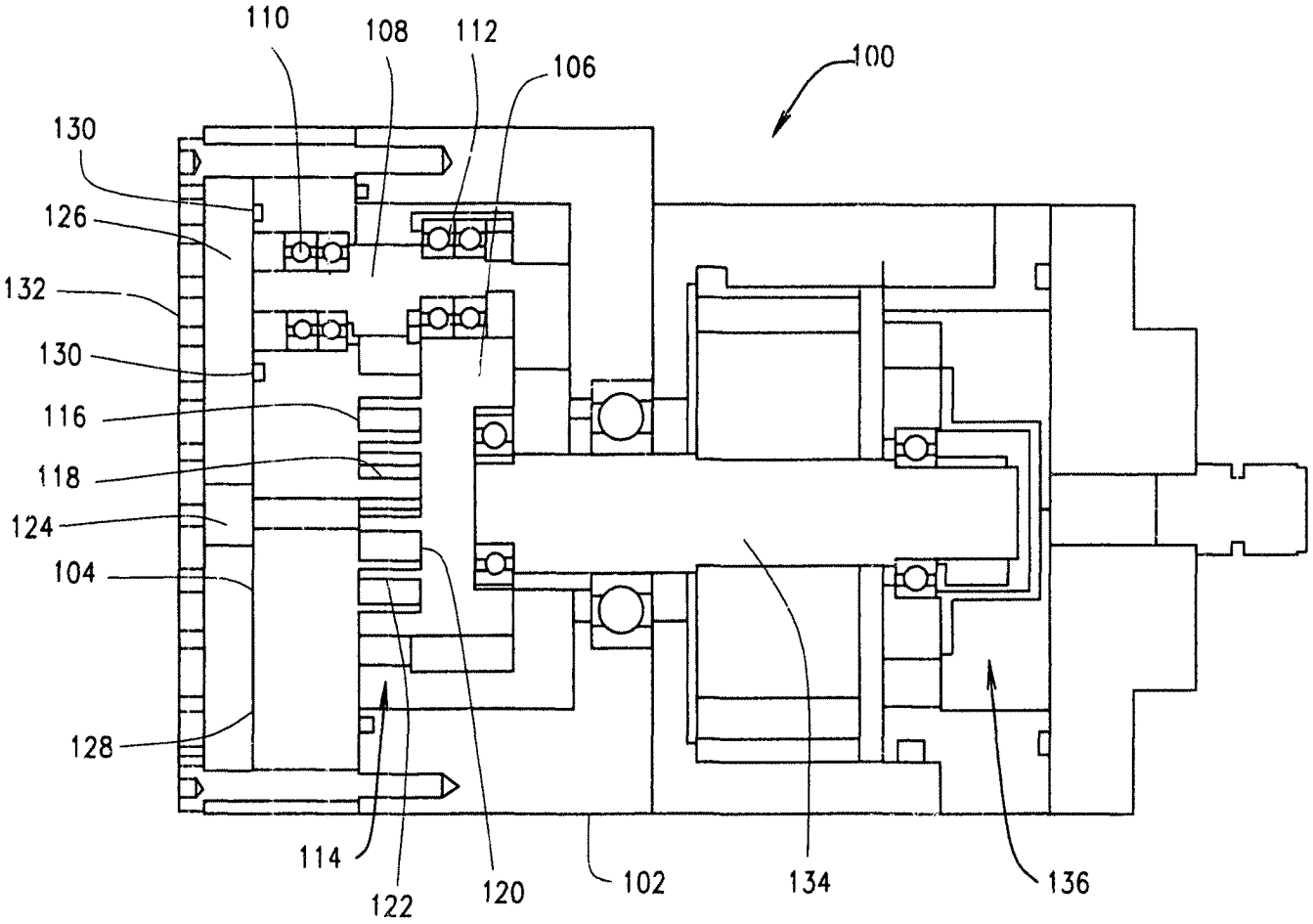
FIG. 2 shows a sectional view of another preferred embodiment of a scroll device having a pressure place constructed according to the present disclosure.

FIG. 2 shows another embodiment of a scroll device 100 having a pressure plate constructed according to the present disclosure. The scroll device 100 comprises a housing 102 which seals the device 100 from the atmosphere, a fixed scroll plate 104 and an orbiting scroll plate 106 mounted therein on an idler shaft 108 rotatable within associated bearings 110 and 112. The idler shaft 108 and other support constructions (not shown) are designed to take the axial loads and to control the motion of and clearance between the scroll plates 104 and 106 as the plates 104 and 106 move relative to one another. The scroll plates 104 and 106 together form a scroll set or scroll plate pair 114. The fixed scroll plate 104 has a side 116 having a fixed interleaved involute scroll 118. The orbiting scroll plate 106 has a side 120 that has an orbiting interleaved involute scroll 122. The scroll plates 104 and 106 move relative to one another, such as in an eccentric orbit relative to one another. The involute scrolls 118 and 122 are interleaved spiral projections that mesh together to expand or contract a working fluid (not shown) that is provided to the scroll set 114. The device 100 has an inlet port 124 for the introduction of a working fluid (not shown) into the device 100 and the scroll set 114. A pressure plate 126 is positioned adjacent to an outward facing side 128 of the fixed scroll plate 104. The pressure plate 126 takes the bulk of the differential pressure between atmospheric pressure and operating pressures within the device 100. By providing the pressure plate 126, the pressure plate 126 is able to deflect and deflection of the fixed scroll plate 104 is prevented or eliminated. By providing the pressure plate 126, the pressure plate 126 is able to deflect and deflection of the fixed scroll plate 104 is prevented or eliminated. In this manner, the pressure plate 126 prevents any damage to the scroll set 114. The pressure plate 126 may be larger than the fixed scroll plate 104. The pressure plate 126 is designed to use the high operating pressure as the interface pressure in the device 100. The high operating pressure of the device 100 refers to the pressure at the inlet port 124. If the scroll device 100 is an expander then the high operating pressure will at the inlet port 124. A low operating pressure will be at the outlet (now shown) of the device 100. Also, the device 100 has an 0-ring 130 provided around the idler shaft 108 instead of the inlet port 124.

The housing 102 may also have fins 132 provided thereon for transferring heat primarily from the fixed scroll 104 and the orbiting scroll 106 to the housing 102 for evacuation by conduction or a fan (not shown) integrated into the housing 102. A shaft 134 may be connected to the orbiting scroll plate 106. A motor (not shown) may be connected to the shaft 134 to rotate the shaft 134 and in turn rotate the orbiting scroll plate 106. The motor may be magnetically connected to the shaft 134 by a magnetic coupling 136. The magnetic coupling 136 is used for transmitting the torque from the motor to the orbiting scroll plate 106 for appropriate rotation without leakage of the working fluid to the atmosphere. Generally, the motor supplies rotation to the magnetic coupling 136 which then imparts rotation and torque to the shaft 134 and the orbiting scroll plate 106 for usage as a compressor or vacuum pump while a generator (not shown) supplies rotation to the orbiting scroll plate 106 when the device 100 is used as an expander.

Again, although one idler shaft 108 is shown, typically there are three idler shafts that are preferably spaced approximately 120° from each other around the outside of the scroll plates 104 and 106. Although the idler shafts 108 is shown positioned between the fixed scroll plate 104 and the orbiting scroll plate 106, the idler shaft 108 could just as easily be located between the orbiting scroll plate 106 and the housing 102.

Although not shown, it is contemplated that the scrolls 28 and 32 or the scrolls 118 and 122 can be readily sealed with tip seals (not shown) in acceptable conventional manners and using acceptable conventional materials, including elastomeric sealing materials. U.S. Pat. No. 6,511,308 discloses several examples of acceptable manners and materials for tip seals, which manners and materials should not be considered or treated as being limiting or exhaustive, however.

From the aforementioned description, a scroll device from the machine class of scroll compressors, pumps, and expanders has been described. This scroll device is uniquely capable of expanding or compressing a fluid cyclically to evacuate a line, device, or space connected to the pump without intrusion of the nearby atmosphere. During operation, the scroll device generates heat within its fixed and orbiting scrolls which is dissipated through cooperating fins upon the surrounding housing. The scroll device may receive its motive power directly from a motor or alternatively from a motor connected to a magnetic coupling, further minimizing the incidence of atmospheric intrusion within the housing and the working fluid. The present disclosure and its various components may adapt existing equipment and may be manufactured from many materials including but not limited to cast metal, metal sheets and foils, elastomers, steel plates, polymers, high density polyethylene, polypropylene, polyvinyl chloride, nylon, ferrous and non-ferrous metals, their alloys, and composites.

From all that has been said, it will be clear that there has thus been shown and described herein a scroll device having a pressure plate. It will become apparent to those skilled in the art, however, that many changes, modifications, variations, and other uses and applications of the subject scroll device having a pressure plate are possible and contemplated. All changes, modifications, variations, and other uses and applications which do not depart from the spirit and scope of the disclosure are deemed to be covered by the disclosure, which is limited only by the claims which follow.

What is claimed is:

1. A scroll device comprising:

a housing having a fixed scroll plate and an orbiting scroll plate mounted therein on an idler shaft, the fixed scroll plate having a side having a fixed interleaved involute scroll and an outward facing side, the orbiting scroll plate having a side that has an orbiting interleaved involute scroll;

an inlet port for the introduction of a working fluid into the scroll device; and a deflectable pressure plate positioned adjacent to the outward facing side of the fixed scroll plate.

2. The scroll device of claim 1 wherein the pressure plate is larger than the fixed scroll plate.

3. The scroll device of claim 1 wherein the orbiting scroll plate moves relative to the fixed orbiting scroll plate in an eccentric orbit.

4. The scroll device of claim 1 further comprising fins on the housing.

5. The scroll device of claim 1 wherein the fixed interleaved involute scroll and the orbiting interleaved involute scroll are interleaved spiral projections that mesh together to expand or contract a working fluid.

6. The scroll device of claim 1 wherein the pressure plate is positioned adjacent to the idler shaft.

7. The scroll device of claim 1, wherein the working fluid has an operating pressure, and a pressure differential is the difference between the operating pressure and an ambient pressure, wherein the pressure plate deflects in response to the pressure differential.

8. A scroll device comprising:

a housing having a fixed scroll plate and an orbiting scroll plate mounted therein on an idler shaft, the fixed scroll plate having a side having a fixed interleaved involute scroll and an outward facing side, the orbiting scroll plate having a side that has an orbiting interleaved involute scroll;

an inlet port for the introduction of a working fluid into the scroll device in the case of an expander;

an O-ring located around the idler shaft; and a pressure plate positioned adjacent to the outward facing side of the fixed scroll plate.

9. The scroll device of claim 8 wherein the orbiting scroll plate moves relative to the fixed orbiting scroll plate in an eccentric orbit.

10. The scroll device of claim 8 further comprising fins on the housing.

11. The scroll device of claim 8 wherein the fixed interleaved involute scroll and the orbiting interleaved involute scroll are interleaved spiral projections that mesh together to expand or contract a working fluid.

12. The scroll device of claim 8 wherein the pressure plate is larger than the fixed scroll plate.

13. The scroll device of claim 8 wherein the pressure plate is positioned adjacent to the idler shaft.

14. The scroll device of claim 8, wherein the pressure plate deflects in response to a pressure differential between an operating pressure within the scroll device and an ambient pressure.

* * * * *